US007637387B1

(12) United States Patent
Cantolino

(10) Patent No.: US 7,637,387 B1
(45) Date of Patent: Dec. 29, 2009

(54) FLUID COLLECTION AND DRAIN PAN WITH INTEGRATED STRENGTH-ENHANCING STRUCTURE

(76) Inventor: Christopher Ralph Cantolino, 2614 Manatee Ave. West, Bradenton, FL (US) 34205

( * ) Notice: Subject to any disclaimer, the term of this patent is extended or adjusted under 35 U.S.C. 154(b) by 301 days.

(21) Appl. No.: 11/903,421

(22) Filed: Sep. 21, 2007

(51) Int. Cl.
*B65D 1/36* (2006.01)
*B65D 1/34* (2006.01)
*F25D 21/14* (2006.01)

(52) U.S. Cl. ..... 220/571; 220/501; 62/285; 62/289; 62/291

(58) Field of Classification Search ..... 220/501, 220/516, 517, 571, 573, DIG. 2, DIG. 15; 62/285, 288–291
See application file for complete search history.

(56) References Cited

U.S. PATENT DOCUMENTS

D264,066 S * 4/1982 Smith et al. ..... D34/38
4,637,225 A * 1/1987 Marshall et al. ..... 62/285
4,687,604 A * 8/1987 Goettl ..... 261/29
4,733,790 A * 3/1988 Stein ..... 220/23.83
4,783,971 A * 11/1988 Alba ..... 62/291
4,930,632 A * 6/1990 Eckert et al. ..... 206/386
D333,028 S * 2/1993 Lux, Jr. ..... D34/38
5,249,699 A * 10/1993 Williams ..... 220/571
D370,765 S * 6/1996 Heintz ..... D34/38
5,660,867 A * 8/1997 Reynolds et al. ..... 426/112
5,908,133 A * 6/1999 Luburic et al. ..... 220/572
6,116,266 A * 9/2000 Dickison et al. ..... 137/312
6,367,645 B1 * 4/2002 Trygg ..... 220/513
6,637,453 B2 * 10/2003 Robinson ..... 137/312
6,719,164 B2 * 4/2004 Maschio ..... 220/571
6,868,689 B1 * 3/2005 McNeil et al. ..... 62/285
D562,963 S * 2/2008 Cantolino et al. ..... D23/386
2003/0057114 A1 * 3/2003 Brander ..... 206/204
2005/0109055 A1 * 5/2005 Goetzinger et al. ..... 62/291
2008/0000250 A1 * 1/2008 Cantolino ..... 62/285

* cited by examiner

*Primary Examiner*—Anthony Stashick
*Assistant Examiner*—Ned A Walker
(74) *Attorney, Agent, or Firm*—Dorothy S. Morse

(57) ABSTRACT

A one-size-fits-all pan configured for supporting a fluid-producing unit. It has a perimeter wall spaced apart from a raised central structure to provide a moat-like area for flow of collected fluid toward a wall-mounted shut-off switch. When a desired maximum amount of fluid collection is exceeded, an electrical signal is sent to stop fluid production. The raised central structure comprises a hub with radially-extending ribs that each widens into a bent distal end having non-uniform height and width dimensions, and top indentations for receipt of vibration isolators that support the fluid-producing unit at a height above that of the perimeter wall. The non-raised areas around the ribs are all connected to the moat-like area to facilitate even fluid distribution within the pan. The pan further has an up-turned perimeter lip, staggered gussets, and angled corners for added strength, and may optionally have a nesting configuration for compact storage and transport.

17 Claims, 4 Drawing Sheets

FLUID COLLECTION AND DRAIN PAN WITH INTEGRATED STRENGTH-ENHANCING STRUCTURE

CROSS-REFERENCES TO RELATED APPLICATIONS

None.

BACKGROUND

1. Field of the Invention

This invention relates to fluid collection pans used in association with a fluid or condensate producing or system such as a commercial or residential air conditioning system as well as those used to prevent damage caused by leaks in fluid-holding containers, such as a hot water heater, specifically to a one-size-fits-all fluid-collecting pan or tray (hereinafter usually referred to only as "pan") having a generally raised central structure substantially filling its center portion and a surrounding perimeter wall at a spaced-apart distance from the central structure to provide a moat-like area for the movement of collected fluid toward a float switch mounted on the perimeter wall, which if deployed will send a shut-off signal to the fluid-producing unit associated with the pan when a predetermined threshold amount of collected fluid considered safe is exceeded. The raised central structure contains a center hub from which at least four raised ribs extend diagonally or radially outward toward the perimeter wall, with each rib widening into a bent distal end having non-uniform height and width dimensions that provide fluid-producing support with enhanced air circulation between it and the bottom of the pan. In addition to the bent distal end, each rib may also have a tailpiece extending from its distal end in the opposed direction to its widened bent distal end. Further, the hub and widened bent distal ends have top indentations each configured for receipt of a vibration isolator that supports the fluid-producing unit at a height above that of the perimeter wall so that the bottom of the fluid-producing unit does not contact collected fluid should overflow ever occur, and in furnace applications may provide the required clearance from non-combustible substances The non-raised areas adjacent to the center hub and ribs are all connected to the moat-like area near the perimeter wall to provide substantially even distribution of collected fluid throughout the pan. The raised central structure is designed to support a heavy load, reduce pan twisting, and prevent the pan material from creasing during installation and use that otherwise might occur when the pan is bent, thereby avoiding a potential source of premature pan failure that is common in many prior pans used for fluid/condensate collection. The raised central structure is also configured to provide even pull of plastic material during pan manufacture to prevent weak spots that could be a later source of premature pan failure. It is contemplated for the present invention pan to be made from sturdy and resilient materials, optionally have an up-turned perimeter lip to provide increased height for additional fluid collection, for the base of its perimeter wall to have a plurality of strengthening gussets preferably in staggered array, and for any corners in perimeter wall to optionally have an angled configuration for added strength. It is also optional, but preferred, for the raised central portion, the gussets, and any mounting plate or other mount for a switch/drain assembly to each have a nesting configuration for compact storage and transport of stacked present invention pans. Further, one or more indentations in the top of the center hub, as well as atop the widened bent distal ends, are each configured to receive at least one vibration isolator (or other dampening insert), which is the only part of the present invention structure that typically is visible above the perimeter wall. The number of indentations and vibration isolators used in the present invention is not limiting, and may vary according to the intended application as long as there are a sufficient number to allow for the one-size-fits-all objective. It is contemplated for positioning of the vibration isolators to alternatively allow the support of different sizes of fluid-producing units that partially or fully extend across the raised central structure of the pan. Also, although the present invention is primarily contemplated for use in air conditioning and/or furnace condensate collection and fluid overflow prevention applications where the supported air conditioning unit or furnace is installed in a vertical orientation, it may also be used in other overflow prevention applications, such as but not limited to that involving the support of one or more hot water heaters or other fluid-holding units having seals and/or other fluid connections that are at risk for failure over time, and wherein the installation is also in an area subject to property damage should fluid leakage or overflow occur.

2. Description of the Related Art

When air conditioning and/or furnace condensate and other condensates are collected, there is often a risk of overflow or back-up into the system producing it. As a result, a pan or tray is typically placed under the condensate-producing unit and a liquid-level float switch is employed with the pan to shut-off the source of condensate flow when the amount of fluid collected exceeds a predetermined threshold depth considered safe. Prior art air conditioning and/or furnace condensate collection pans have many different upper edge configurations, length and width dimensions, thickness dimensions, and are made from a variety of plastic and metal materials. Some are made from materials that deform in hot attics, resulting in float switch malfunction and fluid leakage. Also, there are different sizes of fluid-producing units, many times requiring the use of different sizes of pan, which causes extra expense to installers by requiring them to purchase and store multiple sizes of pan in advance of installations. In contrast, the raised central portion of the present invention is sized, configured, and ruggedly constructed so that it can be used for support of a majority of the common sizes of air conditioning units and furnaces installed today in residential and commercial applications. Since the size and sturdiness of the present invention is sufficient for routine installation of residential air conditioning system air handlers and furnaces in upright orientation, the present invention can also be used for support of upright fluid-holding units in locations where property damage is likely should fluid leakage or overflow occur, such as but not limited to the installation of a hot water heater in a basement. Further, when an installer or repairman works with a prior art fluid collection pan that is unit-dedicated, the installers and repairmen have the added expense of maintaining a supply of at least several different kinds of float switches, some adapting better to the thinner upper edge of metal condensate collection pans, and others more suited to the variable thicknesses found in existing plastic condensate collection pans. In addition, prior art fluid collection pans are often large and may need to be elevated or placed in a tight space, such as during attic installations. As a result fluid-collection pans are at risk for bending and/or being stepped on one or more times by the installer. If the materials used a fluid-collection pan are thin or weak in any way, it will be subject to cracks and weak spots, which are likely to cause fluid leakage and require premature replacement. Thus, a primary objective of the present invention is to provide a one-size-fits-all condensate pan design that will evenly pull plastic during manufacture to avoid weak spots that can lead to premature pan failure. The resulting fluid collection pan is sturdy and will support an air conditioning system air handler or furnace in an upright orientation, thus making installations possible in tight spaces where a larger pan for a horizontal installation would not fit. In addition, when providing at least one preconfigured and sturdily constructed mounting shelf for a liquid-level float switch and fluid drain assembly is made a part of the present invention perimeter wall, leveling of the assembly's float body occurs as the pan itself is leveled. Thus, pan installation is facilitated and installation time is shortened, stable float switch installation is provided as well as trouble-free long-term float switch use, float switch maintenance after installation is minimized, and the guess-work is removed for installers as they no longer need to select and mount an appropriately matched float switch to an existing condensate collection pan in order to provide immediate, reliable, and reproducible electrical shut-off action during long-term use when the condensate collected in the pan exceeds a pre-established or custom-set threshold amount considered safe. Once the present invention pan is leveled, the only float switch body adjustment that an installer may need to make is a simple custom height adjustment, if needed or desired. Further, the design of the raised central structure can provide nested storage, which makes transport of stacked present invention pans less expensive. The sturdiness of the pan and mounting plate construction in the present invention, in addition to the configuration and placement of the float switch and fluid drain assembly used with the present invention pan, allows the float switch body to remain in original orientation for reliable operation during the entire time period of use, preventing the sagging or perimeter wall lean-in that often causes failure of prior art float switches and requires frequent post-installation inspection and maintenance. No other fluid-collection pan for fluid overflow prevention is known that functions in the same manner or provides all of the advantages of the present invention.

BRIEF SUMMARY OF THE INVENTION

It is the primary object of this invention to provide a fluid-collecting pan of sturdy construction for use in long duration, stable, and pre-leveled support of a liquid-level float switch and fluid drain assembly in its originally installed position for reliable repeated operation, as needed, to turn off fluid production in a fluid-producing system supported upon the pan when fluid accumulation in the pan exceeds a pre-established threshold amount considered safe. It is also an object of this invention to provide a fluid collection pan that is not unit-dedicated, and can be used with multiple sizes and configurations of fluid-producing units to save installers the expense of purchasing and storing a multitude of unit-dedicated pans for their installations. It is a further object of this invention to provide a fluid collection pan with strengthening features that allow it to effectively fulfill its intended fluid collection function while resisting permanent deformation, cracking, and/or weakening of materials as a result of installer manipulation, as well as that resulting from pre-installation handling during transport and storage. A further object of this invention is to provide a fluid collection pan that is sufficiently rugged for upright fluid-producing units in small spaces. It is also an object of this invention to provide a fluid collection pan that enables stable pan installation, facilitates pan and float switch installation, shortens pan and float switch installation time, and requires minimal post-installation inspection and maintenance. A further object of this invention is to provide a fluid collection pan with a nesting structure for efficient transport and storage of multiple pans in stacked array. In addition, it is a further object of the present invention to provide a fluid collecting pan made from corrosion-resistant materials that resist premature deterioration and malfunction, as well as materials resistant to temperature extremes for installation in 140-degree attics and unheated basements, utility rooms, or garages.

The present invention, when properly made and used, will provide a fluid collecting pan of sturdy construction and resilient materials for reliable long term use. Pan strength is derived from its raised central structure that substantially fills its center portion and comprises a center hub from which at least four raised ribs extend diagonally or radially in an outward direction toward the perimeter wall, with each rib widening into a bent distal end having non-uniform height and width dimensions. A tailpiece is also associated with the distal end of each rib, which extends in the direction opposed to that of the widened bent distal end. The raised central structure is configured to provide even pull of plastic material during pan manufacture to prevent weak spots that could be a later source of premature pan failure. The raised central structure is also designed to support a heavy load, reduce pan twisting during installation and use, and prevent the pan material from creasing should it become bent during installation or use, thereby avoiding a potential source of premature pan failure that is common in many prior art pans used for fluid collection purposes. Pan strength is also derived from a perimeter wall surrounding the raised central structure and having a plurality of staggered gussets, an option of at least one perimeter rib, an option of at least one sturdy float switch mounting shelf, and the option of angled corner reinforcement. The perimeter wall may be rectangular in configuration, or have a circular, octagonal, hexagonal, or other perimeter configuration appropriate to the intended application and installation site. In all embodiments, it is contemplated for the raised central structure to substantially fill its center portion and the widened bent distal ends of the ribs to substantially follow the perimeter wall configuration, typically having an angular configuration when the perimeter wall is rectangular and an arcuate configuration when the perimeter wall has a circular configuration. The design of the raised central structure and the strengthening features in the most preferred embodiment of the present invention further allow for the nesting of multiple stacked present invention pans, which permits their compact storage and transport. The spaced-apart distance between the raised central structure and the perimeter wall provides a moat or moat-like area for the movement of collected fluid toward a float switch mounted on the perimeter wall, which if deployed will send a shut-off signal to the fluid-producing unit associated with the pan when a predetermined threshold amount of collected fluid considered safe is exceeded. The threshold can be pre-set during manufacture, set at the time of installation, or later re-set at any time indicated by changing fluid collection volume or need. The non-raised areas adjacent to the hub and ribs are all connected to the moat-like area near the perimeter wall to provide substantially even distribution of fluid collected in the pan. The one-size-fits all objective of the present invention is fulfilled by a plurality of indentations in the top of the widened bent distal ends of the ribs, as well as atop the center hub, which are each configured to receive at least one vibration isolator (or other dampening insert), which is the part of the present invention upon which the fluid-producing unit is supported to prevent/reduce movement of the fluid-producing unit from its originally installed position during routine operation. Stacked vibration isolators (or other dampening insert) in the same indentation can raise the height of the fluid-producing unit to facilitate its installation. Further, from a side view, the vibration isolators are the only part of the present invention structure that is visible above the perimeter wall. For furnace installations requiring a non-combustible clearance, vibration isolators made from non-combustible materials can satisfy this requirement. Also, use of non-combustible pieces or assemblies can be used in place of, or in addition to, the vibration isolators contemplated for used with air conditioning system air handlers. Vibration isolators also raise the bottom of a fluid-producing unit sufficiently so that it does not sit in collected fluid in fluid overflow situations. The number of indentations and vibration isolators used is not limiting and may be different from one embodiment of the present to another. However, the number and positioning of the vibration isolators used should alternatively allow the support of different sizes of heavy fluid-producing units that partially or fully extend across the raised central structure of the pan, as well as enhance the circulation of air between the bottom of the fluid-producing unit and the pan. Thus, not every indentation in the widened bent distal ends or center hub may have a vibration isolator associated with it during present invention support of a fluid-producing unit. Also, although the present invention is primarily contemplated for use in air conditioning and/or furnace condensate collection/overflow prevention applications where the air conditioning unit or furnace is in a vertical orientation, it may be used in other applications where rising fluid beyond a threshold limit is undesirable and automated shut-off of the fluid source is needed to eliminate the risk of property damage, such as but not limited to support of a hot water heater. Since the fluid collecting pan of the present invention is made from corrosion-resistant plastic materials, premature deterioration and malfunction due to corrosion are avoided. The present invention pan materials are also resistant to deterioration from temperature extremes. When the present invention has a perimeter wall mounting shelf for a switch/drain connection assembly, the assembly can be pre-installed on the mounting shelf or installed on-site as the pan is placed into its desired position of use, with both resulting in stable float switch installation and minimal float switch maintenance after installation.

The description herein provides preferred embodiments of the present invention but should not be construed as limiting its scope. For example, variations in the number, placement, size, and configuration of the gussets in the perimeter wall; the length, width and height dimensions of the center hub and the radially-extending ribs; the height dimension of the perimeter wall's up-turned lip, the number of vibration isolators and indentations used in the hub and widened bent distal ends, and the type of vibration isolators or other dampening inserts used with present invention indentations, other than those shown and described herein, may be incorporated into the present invention. Thus the scope of the present invention should be determined by the appended claims and their legal equivalents, rather than being limited to the examples given.

DETAILED DESCRIPTION OF PREFERRED EMBODIMENTS

Figure 3:
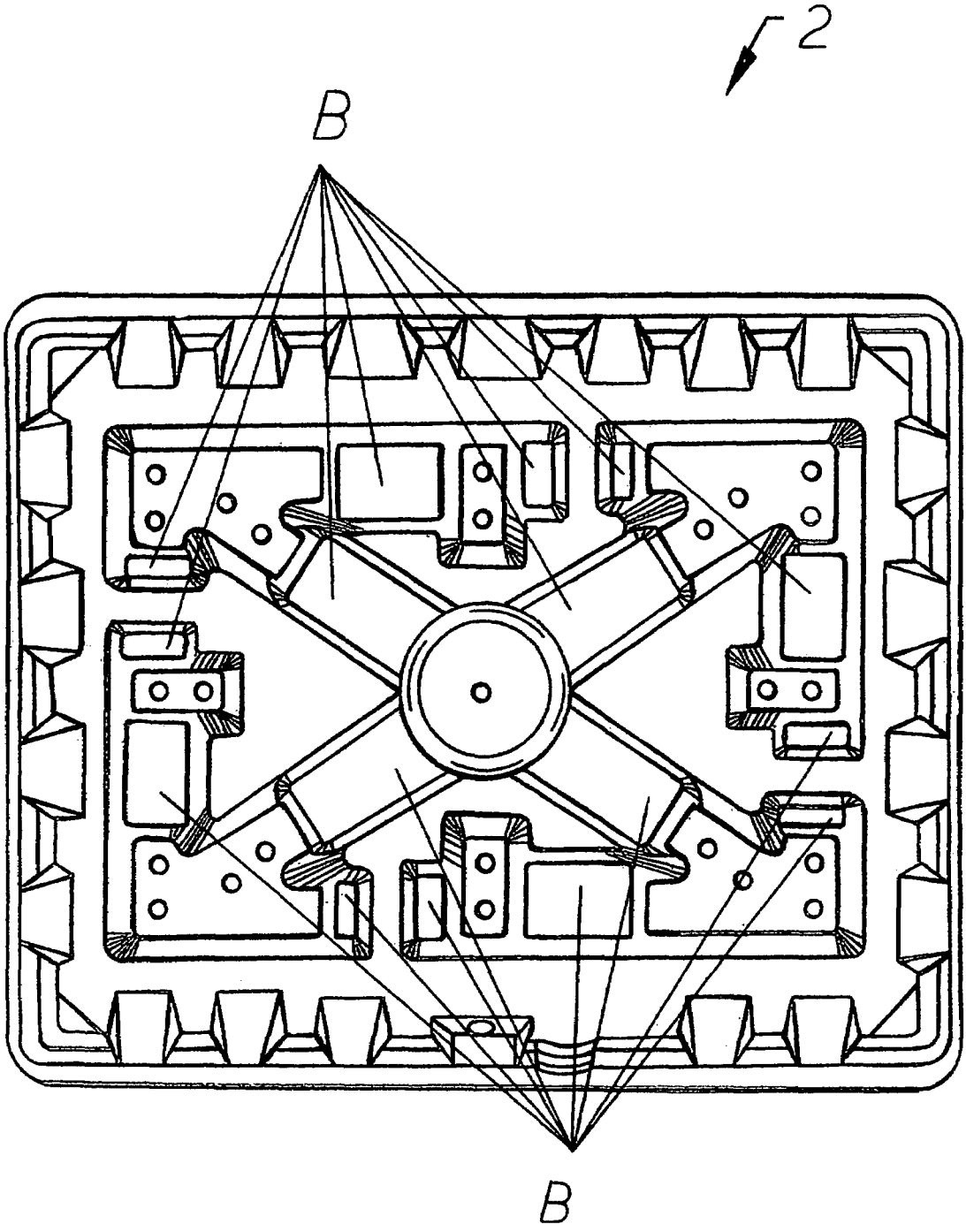
FIG. 3 is a top view identifying the lowered portions of the bent distal ends and tailpieces that in combination with the radially-extending ribs do not provide support for a fluid-producing system in the most preferred embodiment of the present invention, but instead enhance air circulation under the fluid-producing unit while supported by the hub and widened bent distal ends.
Figure 4:
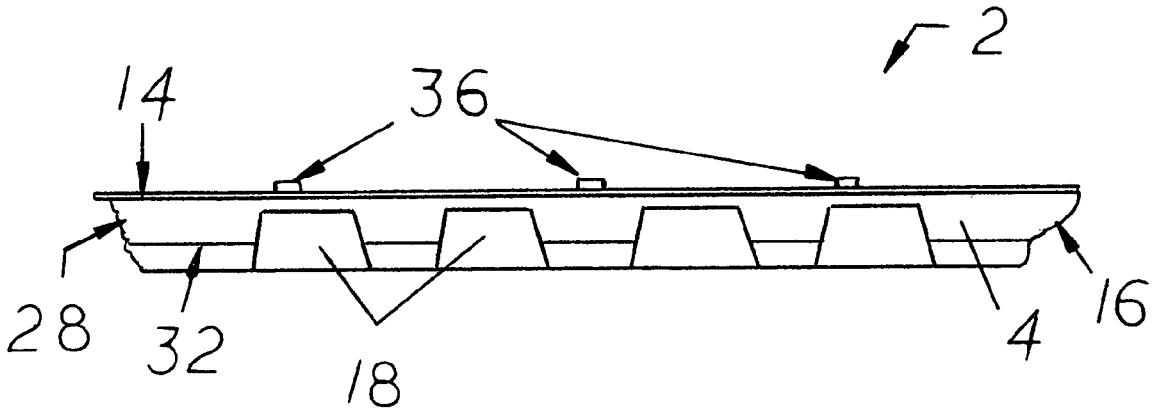
FIG. 4 is a side view the most preferred embodiment of the present invention with several vibration isolators secured to the top portions of the widened bent distal ends, which are lower in height than the perimeter wall and not identified numerically since they are hidden from view.
Figure 5:
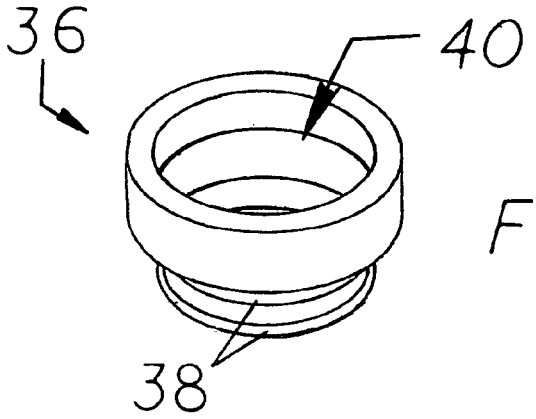
FIG. 5 is a perspective view of a vibration isolator having a ring-shaped configuration that is contemplated for use in the most preferred embodiment of the present invention.
Figure 7:
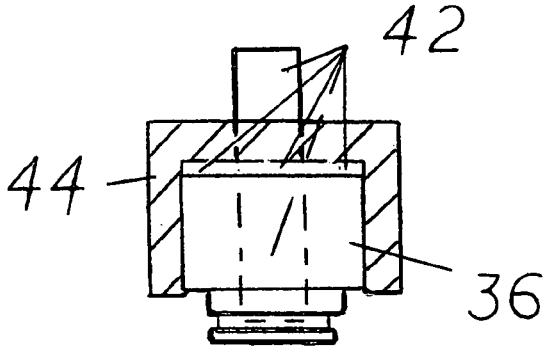
FIG. 7 is a perspective view of a ring-shaped vibration isolator contemplated for use in furnace applications of the present invention with an associated clearance assembly made from non-combustible materials positioned over it to satisfy furnace clearance requirements.
Figure 6:
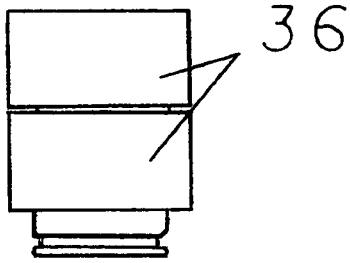
FIG. 6 is a perspective view of two ring-shaped vibration isolators in the most preferred embodiment of the present invention in stacked array.

While FIGS. 1-7 reveal the structure of the most preferred embodiment 2 of the present invention, it is to be understood that many variations in the present invention are possible. Those that are not patentably distinct from the most preferred embodiment 2 disclosed herein are also considered to be within the scope of, and a part of, the present invention, even though they may not be specifically mentioned or shown. As a result, a reader should determine the scope of the present invention by the appended claims. FIGS. 1-4 show the most preferred embodiment 2 of the present invention, while FIGS. 5-7 show preferred configurations of a vibration isolator 36 that can be used as a part of the present invention.

Figure 1:
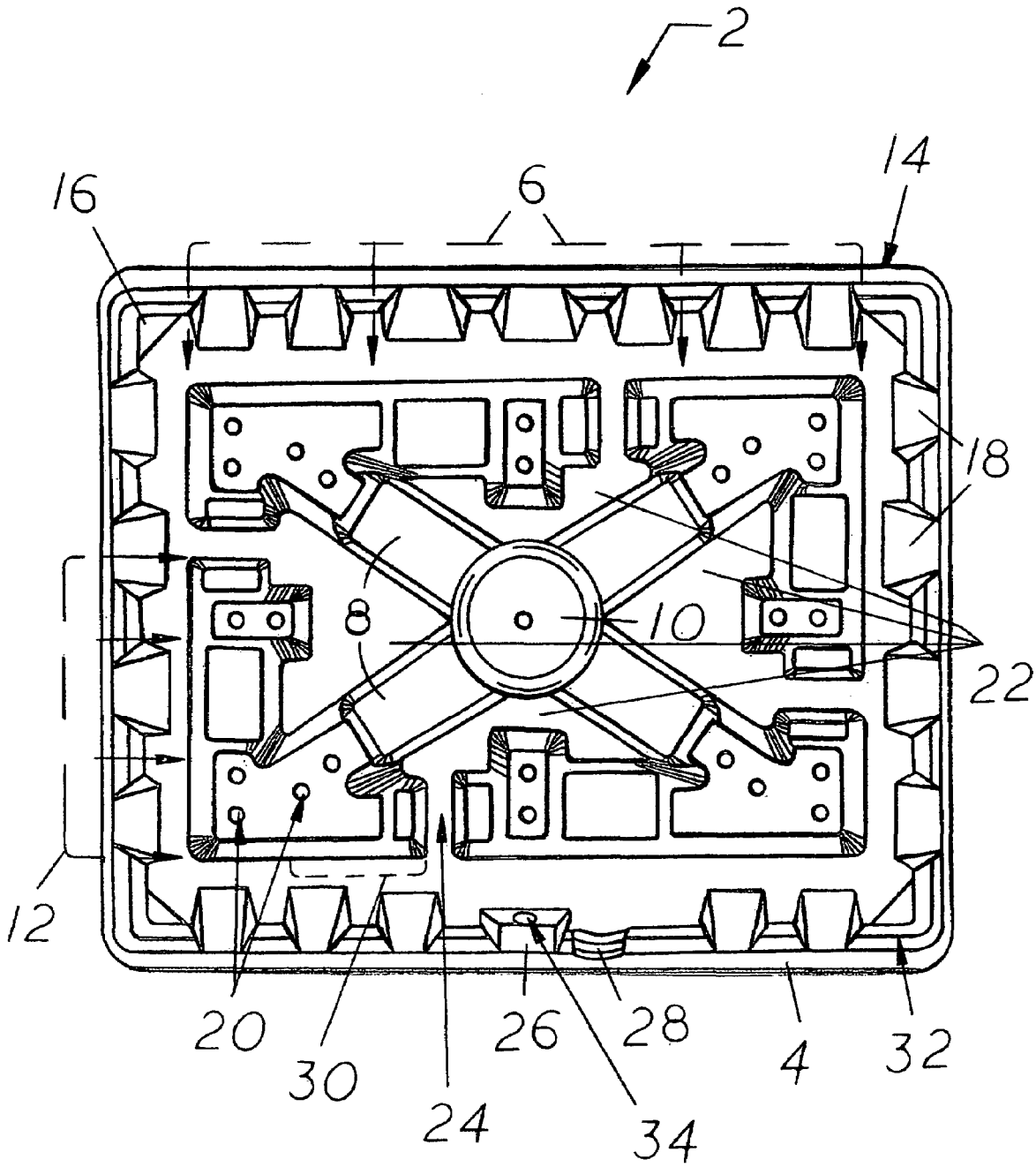
FIG. 1 is a top view of the most preferred embodiment of the present invention condensate pan having a center portion, a perimeter wall surrounding the center portion, a raised central structure substantially filling the center portion, the perimeter wall having a mounting shelf configured for rapid and easy connection of a combined liquid-level float switch and fluid drain assembly, a moat between the raised central structure and the perimeter wall for even movement of collected fluid toward the float switch, the perimeter wall also having strengthening gussets in staggered array, an up-turned perimeter lip, a horizontally-extending perimeter rib between gussets, and angled corner reinforcement, and the center portion having a raised central structure with a center hub, four radially-extending ribs each having a widened bent distal end extending in a counterclockwise direction, and a tailpiece extending in the opposed direction from the widened bent distal end.
Figure 2:
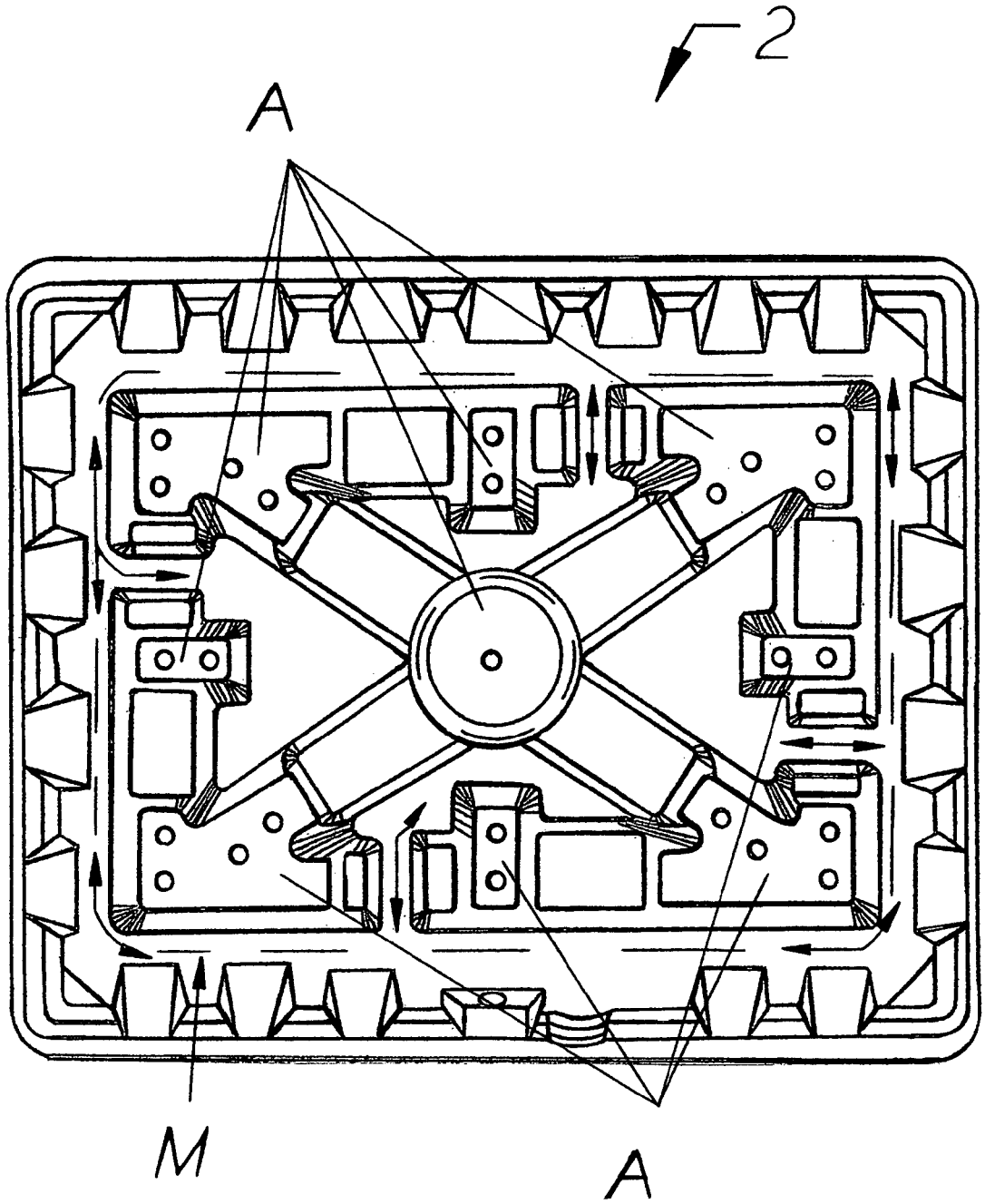
FIG. 2 is a top view identifying the raised portions of the bent distal ends and tailpieces that in combination with the center hub provide support for a fluid-producing system in the most preferred embodiment of the present invention.

FIGS. 1-3 show top views of the most preferred embodiment 2 of the present invention fluid collection and drain pan, with FIG. 1 identifying present invention components by number, FIG. 2 identifying by the letter "A" highly raised portions of the bent distal ends 12 and tailpieces 30 that in combination with the center hub 10 provide support for a fluid-producing unit (not shown), and FIG. 3 identifying by the letter "B" low-rise portions of the bent distal ends 12 and tailpieces 30 that in combination with the radially-extending ribs 8 provide enhanced air circulation below a fluid-producing unit but no support for it. FIG. 1 shows most preferred embodiment 2 having a perimeter wall 4 extending around a center portion which comprises a raised central structure 6 and a moat (identified by "M" in FIG. 2). For clarity of illustration moat M was not identified in FIG. 1, as there was more room in FIG. 2 to show fluid flow within moat M (and its interaction with exit channels 24) using broken lines and two-headed arrows. Raised central structure 6 substantially fills the center portion defined by perimeter wall 4, with moat M positioned between raised central structure 6 and perimeter wall 4 and providing even movement of collected fluid (not given a numerical designation) toward a float switch (not shown) secured adjacent to perimeter wall 4 by mounting shelf 26. As a result, pooling of collected fluid (not shown) in one area of most preferred embodiment 2 does not occur, which could otherwise lead to sagging and/or buckling of present invention material if it were placed upon blocks or other supports during its installation. Although FIGS. 1-4 show a rectangular perimeter wall 4 configuration, the rectangular shape is not critical, and in the alternative perimeter wall 4 may have a circular, hexagonal, octagonal, or other closed perimeter configuration that results in a sufficiently large raised central structure 6 to provide the needed support and fluid collection functions for the fluid-producing unit (not shown) intended for use with it. FIGS. 1-3 also show the mounting shelf 26 on perimeter wall 4 having a configuration facilitating rapid and easy connection thereto of a combined liquid-level float switch and fluid drain assembly (shown in other U.S. patents of the inventor herein, but not a part of this disclosure). The ribbed area 28 adjacent to mounting shelf 26 also has a configuration that strengthens perimeter wall 4, in addition to having the dimension and configuration to protect a float switch (not shown) from side impact during and after its installation as a part of the combined liquid-level float switch and fluid drain assembly that becomes supported by mounting shelf 26. Also, the drain opening 34 shown through mounting shelf 26 allows for controlled evacuation of surplus fluid from moat M and reduces the likelihood of damage to surroundings from fluid overflow. Although one mounting shelf 26 and one ribbed area 28 grouping is shown in FIG. 1, more than one such grouping can be present. The broken lines and arrows in FIG. 2 are provided to illustrate possible multi-directional movement of collected fluid (not shown) within moat M. Further, although an embodiment of the present invention that is patentably indistinct from most preferred embodiment 2 could include raised central structure 6 and a perimeter wall 4 only having staggered gussets 18, and not comprise mounting shelf 26 or ribbed area 28, the use of mounting shelf 26 and ribbed area 28 are preferred in most preferred embodiment 2 as they reduce the time for mounting a float switch (not shown) and help to assure that once mounted it will continue to have reproducible and repeated float body deployment over a long period of time without frequent maintenance or inspection. FIG. 1 also shows and identifies four non-raised areas 22 for fluid collection surrounding center hub 10 and radially extending ribs 8, and the exit channel 24 (four are present) configured to allow collected fluid in each of the non-raised areas 22 to enter moat M. FIG. 1 further shows perimeter wall 4 having a plurality of strengthening gussets 18 in staggered array, an optional curved-up perimeter lip 14 (on all sides of perimeter 4 even though only identified by number on one of its sides), an optional horizontally-extending perimeter rib 32 between gussets 18 that can be used for additional strengthening of perimeter wall 4, and optional angled corner reinforcement 16. The number, size, and positioning of gussets 18 and horizontally-extending perimeter rib or ribs 32 between gussets 18 are not critical as long as perimeter wall 4 can remain sufficiently strong to resist sagging and lean-in when installed in hot attics and otherwise fulfill its function of fluid collection and the providing of stable support for a float switch during long periods of use. In addition, the spacing between gussets 18 can be uniform throughout perimeter wall 4, or not. In addition, raised central structure 6 has a center hub 10, four radially-extending ribs 8 each having a widened bent distal end 12 that extends in a counterclockwise direction and a tailpiece 30 extending in the opposed direction from widened bent distal end 12. Center hub 10 secures and strengthens the proximal ends of ribs 8 that depend from it. The number of ribs 8 is not limited to four, and in other embodiments (such as but not limited to one with a perimeter wall 4 having a circular configuration) there may be a greater or lesser number of ribs 8 than is shown in FIGS. 1-3. Further, although FIG. 1 shows the bent distal ends 12 of ribs 8 extending in a counterclockwise direction, the reverse is also considered to be within the scope of the present invention. Thus, should the bent distal ends 12 in the present invention extend in a clockwise direction, if a tailpiece 30 is also associated with the same rib 8 it is contemplated for it to extend in the opposed direction from bent distal end 12. FIG. 2 identifies the raised portions of the bent distal ends 12 and tailpieces 30 that in combination with the center hub 10 provide support for a fluid-producing unit (not shown) in the present invention. Also, since FIG. 2 had a lower number of identification lines than FIG. 1 or 3, FIG. 2 was selected to display broken lines and double-headed arrows that show the fluid flow around moat M, as well as in and out of non-raised fluid-collection areas 22 via exit channels 24. In contrast, FIG. 3 identifies the low-rise portions of the bent distal ends 12 and tailpieces 30 that in combination with the radially-extending ribs 8 do not provide support for a fluid-producing unit (not shown) in the present invention, but instead enhance air circulation under the fluid-producing unit and contribute to the routine cycles of fluid collection and evaporation expected in moat M and non-raised areas 22 that prevents the associated float switch (not shown) from frequent contact with standing water that could lead to the accumulation of mold, algae, and/or debris around (or on) the float switch and thereby placing it at increased risk for malfunction. Minimal shading is present in FIGS. 1-3 to avoid confusion with the complex structure provided by the numbered features of most preferred embodiment 2. However, it can be seen that the added shading mainly highlights corner elevation relating to the bent distal ends 12 and tailpieces 30.

FIG. 4 is a side view the most preferred embodiment of the present invention with three vibration isolators 36 secured to the top portions of the bent distal ends 12, which are lower in height dimension than perimeter wall 4 and hidden from view. FIG. 4 also shows the up-turned lip 14 preferred on perimeter wall 4, as well as grommets 18, the horizontally-extending strengthening rib 32 between grommets 18, the angled corner 16, and the ribbed area 28 adjacent to mounting shelf 26 that strengthens perimeter wall 4 to protect the float switch portion of a drain connection assembly (not shown) from side impact during installation and use of most preferred embodiment 2. Although only three vibration isolators 36 are shown in FIG. 4, more can be used, and when they are, at least some of them would also be visible above the up-turned lip 14 of perimeter wall 4. Although the length, width, and height dimensions of raised central portion 6, as well as the height and thickness dimensions of perimeter wall 4, are not critical, they must be appropriate to the intended application and not so overly large as to create material waste while also satisfying the objective of a strong and rugged one-size-fits-all fluid collection and drain pan. Although not limited thereto and provided only as an example, two sizes of preferred embodiment 2 are currently contemplated for manufacture, one having a perimeter wall 4 dimension of approximately 30-inches by 30-inches and another having a perimeter wall 4 dimension of approximately 30-inches by 36-inches.

FIGS. 5-7 show several variations in the structure and positioning of a ring-shaped vibration isolator 36 that can be used with most preferred embodiment 2. However, other dampening or vibration reducing members that fulfill a similar function and also have a bottom structure that securely fits (or can be adapted to fit) into one of the indentations 20 on central hub 10 or a bent distal end 12, may also be used, such as but not limited to a dampener having a mushroom-shaped cap made from resilient material. Ring-shaped vibration isolator 36 and any other dampener used needs to be resilient to prevent movement of the supported fluid-producing unit (not shown) away from its originally established position atop central hub 10 and two or more of the bent distal ends 12. Rubber is one contemplated material for vibration isolator 36. Since it is desired for most preferred embodiment 2 to be a one-size-fits-all drain pan, the fluid-producing unit (not shown) selected for use with most preferred embodiment 2 may extend fully across raised central portion 6 or only part of the way across raised central portion 6. If the selected fluid-producing unit is heavy and large, it is likely that at least one vibration isolator 36 (or other) will be placed in each of the indentations 20 shown in FIGS. 1-3. However, if the selected fluid-producing unit (not shown) is smaller and extends only part of the way across raised central portion 6, it is likely that the indentations 20 not directly under the selected fluid-producing unit will not contain any vibration isolator 36 or other dampening member, unless they are installed during manufacture. FIG. 5 shows a vibration isolator 36 with a ring-shaped configuration that provides a central recess or hole 40. FIG. 5 also shows the bottom end of vibration isolator 36 having several sealing ribs 38 that will help to maintain vibration isolator 36 in its desired position of use between an indentation 20 and the bottom surface of a fluid-producing unit (not shown). FIG. 6 shows two vibration isolators 36 in stacked array, which can assist in elevating the associated fluid-producing unit for easier installation. More than two vibration isolators 36 can be stacked together, as long as the materials used for vibration isolator 36 manufacture allow them to maintain the fluid-producing unit they support substantially in its originally installed position during routine use. Although not limited thereto, when vibration isolators 36 are stacked, it is contemplated for each one to have a height dimension above the one directly under it of approximately one-half inch. FIG. 7 shows the same ring-shaped vibration isolator 36 in FIGS. 5 and 6 as a part of a configuration contemplated for use in furnace applications of most preferred embodiment 2, wherein two additional safety pieces are assembled over vibration isolator 36 to satisfy non-combustible clearance requirements. The first safety clearance piece is a T-shaped pin 42 that is secured within the central recess or hole 40 of ring-shaped vibration isolator 36. The upright portion of T-shaped pin 42 may be hollow or solid, as long as it has the strength needed for sustained support of a heavy fluid-producing unit over a long period of routine use. Although not shown, T-shaped pin 42 may have one horizontally-extending shank in the form of a brace secured to its upright member, multiple horizontally-extending braces, or a closed perimeter brace of substantially planar construction having at least one dimension greater than the diameter dimension of the central recess or hole 40 in ring-shaped vibration isolator 36. The second safety clearance piece shown in FIG. 7 with T-shaped pin 42 is an inverted cylindrical cup 44, which although not shown has a central bore in its otherwise closed upper end that is sufficiently large in diameter for insertion therethrough of the top end of the upright member of T-shaped pin 42. Thus, when most preferred embodiment 2 is used to support a furnace, at least one vibration-reducing member (vibration isolator 36 or other dampening insert) is placed in each indentation 20 needed for evenly supporting the bottom surface of the furnace (not shown). A T-shaped pin 42 is then secured within the central recess or hole 40 of each vibration isolator 36 or other dampening insert used. After T-shaped pin 42 and the vibration isolator 36 or other dampening insert are both securely in their usable positions, inverted cylindrical cup 44 is placed over T-shaped pin 42 and at least a portion of the outside surface of vibration isolator 36 or other dampening insert present. When the top end of the upright member of T-shaped pin 42 passes through the central bore (not visible) in the otherwise closed upper end of the inverted cylindrical cup 44, the inside surface of the upper end of inverted cylindrical cup 44 comes to rest upon the horizontally-extending shank of T-shaped pin 42, at a minimum covering as much of the vibration isolator 36 or other dampening insert (not shown) needed to meet non-combustible clearance requirements. Since it is contemplated for T-shaped pin 42 and the inverted cylindrical cup 44 to be made from metal, ceramic, or other materials complying with the non-combustible requirement for furnace installations, vibration isolators 36 do not need to be made from non-combustible material, although they could. Thus, the length dimension of the portion of T-shaped pin 42 extending above inverted cylindrical cup 44, in addition to the height dimension of inverted cylindrical cup 44 itself, is added together to determine compliance with the clearance requirements for safe furnace use. It should be understood that T-shaped pin 42 and inverted cylindrical cup 44 are not critical to the present invention for furnace or other applications, and are merely provided as one way of meeting furnace non-combustible clearance requirements. In the alternative, although not shown, a cone or other shaped piece of non-combustible material could be associated with vibration isolators 36 to raise the fluid-producing unit they support sufficiently above perimeter wall 4 to provide any safety clearance needed for furnace installations. The number of indentations 20 and vibration isolators 36 (or other dampening inserts used) is not limiting, but must be sufficient to provide secure and substantially level support of the fluid-producing unit selected for use with the present invention pan. When evenly spaced across raised central support 6, a small number of vibration isolators 36 (or other dampening inserts used) can be used in some applications, such as but not limited to nine, but other numbers of vibration isolators 36 or other dampening inserts (not shown) can also be used in the same or other present invention applications. Not all indentations 20 need to have a vibration isolator 36 or other dampening insert (not shown) positioned in them while a fluid-producing unit is being supported by the present invention pan. However, a sufficient amount of vibration isolators 36 and/or other dampening inserts (not shown) should be present to maintain the fluid-producing unit in or substantially close to its originally installed position over raised central portion 6.

Since it is desired for most preferred embodiment 2 to have no weak spots that could cause creasing or cracking during installation or use, the upturned perimeter lip 14, staggered gussets 18, horizontally-extending rib 32, and angled corners 16 in perimeter wall 4, as well as the center hub 10, radially-extending ribs 8, bent distal ends 12, tailpieces 30, and top indentations 20 in raised central portion 6 are designed to evenly pull plastic during their manufacture and reduce the possibility of premature pan failure. Also, this same design has nesting characteristics, which allow multiple most preferred embodiment 2 pans to be stacked in a very compact configuration for efficient and cost-saving transport and storage. The storage configuration of most preferred embodiment is still efficient even if one vibration isolator 36 is secured into each indentation 20 present in center hub 10 and bent distal ends 12. Further, the use of mounting shelf 26 facilitates the association of a pre-leveled float switch (not shown) with perimeter wall 4, so that once the most preferred embodiment 2 pan is leveled, no additional installation time is required for a leveling step to assure reliable and reproducible float switch operation during long periods of routine use. If a pre-leveled float switch is used, only adjustment of the vertical displacement through which the deployable float body would move might be required during pan installation to meet site-dictated specifications. Further, the configuration of mounting shelf 26 maintains the original location and orientation of the float switch during the entire time period of its use with the present invention, eliminating the possibility of changes in orientation over time that might otherwise occur as a result of sagging or lean-in of any portion of pan perimeter wall 4 (a common occurrence in the weaker perimeter walls of some prior art pans). The materials from which various embodiments of the present invention fluid collection and drain pan are made can vary, but at a minimum must be impervious to corrosion. Temperature-resistant materials are also desired that are capable of withstanding temperature extremes without sagging or cracking. Preferred materials include but are not limited to polycarbonate, polycarbonate alloys, polycarbonate blends, polycarbonate alloys and blends using ABS, polycarbonate alloys and blends using PBT, polycarbonate alloys and blends using PET, polycarbonate alloys and blends using PP, materials impervious to corrosion, impact resistant materials, heat resistant materials, and materials substantially unaffected when subjected to temperature extremes. Resistance to UV radiation is not necessarily a contemplated feature of most preferred embodiment 2, unless dictated by the application. Many installations of preferred embodiment 2 will be in an attic, basement, garage, or utility room, some of which may be subject to hot or cold temperature extremes. Further, the manufacture of the present invention could be accomplished by blow molding, injection molding, assembly of preformed individual components, or a combination thereof, with the choice of manufacturing being determined by the anticipated purchase cost to consumers and the expected duration of use without maintenance, parts replacement, or repair. Further, in addition to its one-size-fits-all objective for capturing all of the surplus condensate and fluid expected from common sizes of supported fluid-producing units, other factors used to determine the dimensions of most preferred embodiment 2 would include cost considerations, the amount of fluid discharge into the present invention pan that is possible after shut-off of the fluid-producing unit, and the ease of handling at anticipated installation sites, including the tight spaces sometimes found in attics. Minimal maintenance is also a contemplated factor in determining the size and materials needed for most preferred embodiment 2.

I claim:

1. A drain pan for supporting a fluid-producing unit and use with a shut-off switch electrically connected to the fluid-producing unit, said pan comprising:

a perimeter wall;

a raised central structure spaced apart inwardly from said perimeter wall so as to provide a moat configured for a flow of collected fluid toward a shut-off switch mounted on said perimeter wall, said raised central structure having a center hub, a plurality of ribs extending outwardly from said center hub, such that each said rib has a distal end widening into a bent distal end structure having non-uniform height and width dimensions, and said center hub and said bent distal ends each having at least one top indentation;

a plurality of non-raised fluid collection areas around said hub and said ribs that are each connected to said moat in a manner that facilitates and promotes even distribution of fluid within said pan; and a plurality of vibration isolators each configured for supporting a fluid-producing unit over said raised central structure at a height above that of said perimeter wall while being secured within one of said top indentations, whereby when a group of vibration isolators selected from said plurality of vibration isolators are positioned according to fluid-producing unit size and mass for balanced and secure fluid-producing unit support, and are used in said top indentations and a shut-off switch is mounted on said perimeter wall that is electrically connected to the fluid-producing unit, and further when the fluid collection in said pan exceeds the desired maximum amount considered safe, then an electrical signal is sent from the mounted shut-off switch to the fluid-producing unit to stop its fluid production.

2. The pan of claim 1 wherein said raised central structure has a height dimension less than that of said perimeter wall.

3. The pan of claim 1 wherein said perimeter wall further comprises a mounting shelf configured for shut-off switch support in its needed position and orientation of operation by said perimeter wall.

4. The pan of claim 1 wherein said perimeter wall further comprises an up-turned lip.

5. The pan of claim 1 wherein said perimeter wall further comprises at least one angled corner.

6. The pan of claim 1 wherein said perimeter wall further comprises a plurality of strength-enhancing gussets.

7. The pan of claim 6 wherein said perimeter wall further comprises at least one horizontally-extending and strength-enhancing perimeter rib between said gussets.

8. The pan of claim 1 wherein said perimeter wall further comprises strength-enhancing features selected from a group consisting of an up-turned lip, at least one angled corner, spaced-apart gussets, spaced-apart gussets in staggered array, and gussets with at least one horizontally-extending perimeter rib between them.

9. The pan of claim 1 wherein said perimeter wall and said raised central area allow nesting of said pans in stacked array.

10. The pan of claim 1 wherein said raised central structure further comprises a tailpiece associated with said distal end of each of said ribs and said tailpiece extends from said distal end in a direction opposed to that of said bent distal end structure.

11. The pan of claim 1 wherein said pan is made from materials selected from a group consisting of polycarbonate, polycarbonate alloys, polycarbonate blends, polycarbonate alloys and blends using ABS, polycarbonate alloys and blends using PBT, polycarbonate alloys and blends using PET, polycarbonate alloys and blends using PP, materials impervious to corrosion, impact resistant materials, UV-resistant materials, heat resistant materials, and materials substantially unaffected when subjected to temperature extremes.

12. A drain pan for supporting a fluid-producing unit and use with a shut-off switch electrically connected to the fluid-producing unit, said pan comprising:

a rectangular perimeter wall having strength-enhancing features selected from a group consisting of an up-turned lip, at least one angled corner, spaced-apart gussets, spaced-apart gussets in staggered array, and gussets with at least one horizontally-extending perimeter rib between them;

a raised central structure spaced apart from said perimeter wall so as to provide a moat configured for a flow of collected fluid toward a shut-off switch mounted on said perimeter wall, said raised central structure having a center hub, a plurality of ribs extending outwardly from said center hub, such that each said rib has a distal end that widens into a bent distal end structure having non-uniform height and width dimensions, and said center hub and said bent distal ends having a plurality of top indentations;

a plurality of non-raised fluid collection areas around said hub and said ribs that are connected to said moat in a manner that facilitates and promotes even fluid distribution of fluid in said pan; and a plurality of vibration isolators each configured for supporting a fluid-producing unit over said raised central structure as a height above that of said perimeter wall while being secured within one of said top indentations, whereby when a group of vibration isolators selected from said plurality of vibration isolators are positioned according to fluid-producing unit size and mass for balanced and secure fluid-producing unit support, and are used in said top indentations and a shut-off switch is mounted on said perimeter wall that is electrically connected to the fluid-producing unit, and further when the fluid collection in said pan exceeds the desired maximum amount considered safe, then an electrical signal is sent from the mounted shut-off switch to the fluid-producing unit to stop its fluid production.

13. The pan of claim 12 wherein said raised central structure has a height dimension less than that of said perimeter wall.

14. The pan of claim 12 wherein said perimeter wall further comprises a mounting shelf configured for shut-off switch support in its needed position and orientation of operation by said perimeter wall.

15. The pan of claim 12 wherein said raised central structure further comprises a tailpiece associated with said distal end of each of said ribs and said tailpiece extends from said distal end in a direction opposed to that of said bent distal end structure.

16. The pan of claim 12 wherein said perimeter wall and said raised central area allow nesting of said pans in stacked array.

17. The pan of claim 12 wherein said pan is made from materials selected from a group consisting of polycarbonate, polycarbonate alloys, polycarbonate blends, polycarbonate alloys and blends using ABS, polycarbonate alloys and blends using PBT, polycarbonate alloys and blends using PET, polycarbonate alloys and blends using PP, materials impervious to corrosion, impact resistant materials, UV-resistant materials, heat resistant materials, and materials substantially unaffected when subjected to temperature extremes.

* * * * *